US006280576B1

(12) United States Patent
Kuhasalo et al.

(10) Patent No.: US 6,280,576 B1
(45) Date of Patent: Aug. 28, 2001

(54) AFTER-DRYER IN A PAPER MACHINE

(75) Inventors: Antti Kuhasalo; Pasi Ahonen, both of Jyväskylä(FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 08/903,838

(22) Filed: Jul. 31, 1997

Related U.S. Application Data

(60) Provisional application No. 60/030,915, filed on Nov. 14, 1996.

(30) Foreign Application Priority Data

Jul. 31, 1996 (FI) ..... 963024

(51) Int. Cl.[7] ..... D21F 7/00

(52) U.S. Cl. ..... 162/252; 162/265; 162/271; 34/524; 34/535; 34/542; 34/557; 34/611; 34/624; 34/632; 34/636

(58) Field of Search ..... 162/252, 265, 162/271; 34/524, 535, 542, 557, 611, 624, 632, 636

(56) References Cited

U.S. PATENT DOCUMENTS

| | | | | |
|---|---|---|---|---|
| 4,202,113 | * | 5/1980 | Kankaanpaa | 34/23 |
| 4,441,263 | | 4/1984 | Vedenpää | 34/115 |
| 4,502,231 | | 3/1985 | Fissmann et al. | 34/114 |
| 4,516,330 | | 5/1985 | Eskelinen et al. | 34/23 |
| 4,661,198 | | 4/1987 | Simmonds, Jr. et al. | 156/578 |
| 4,905,380 | | 3/1990 | Eskelinen et al. | 34/23 |
| 5,022,163 | | 6/1991 | Ilvespää et al. | 34/23 |
| 5,065,529 | * | 11/1991 | Skaugen et al. | 34/117 |
| 5,172,491 | | 12/1992 | Ilvespää et al. | 34/115 |
| 5,269,074 | * | 12/1993 | Sims et al. | 34/117 |
| 5,416,980 | * | 5/1995 | Ilvespaa | 34/117 |
| 5,495,678 | | 3/1996 | Ilmarinen et al. | 34/117 |
| 5,690,999 | * | 11/1997 | Rantanen | 427/355 |
| 5,756,156 | * | 5/1998 | Elijoki et al. | 427/316 |

FOREIGN PATENT DOCUMENTS

| | | | |
|---|---|---|---|
| 2151287 | 12/1995 | (CA) . | |
| 9414963 | 12/1994 | (DE) . | |
| 0655528 | 5/1995 | (EP) . | |
| 0695828 | 2/1996 | (EP) . | |
| 98387 | 8/1996 | (FI) | D21F/5/04 |
| 951748 | 10/1996 | (FI) | D21F/5/04 |

* cited by examiner

*Primary Examiner*—Sean Vincent
(74) *Attorney, Agent, or Firm*—Steinberg & Raskin, P.C.

(57) ABSTRACT

A method and arrangement for drying a paper to be surface-treated, in particular fine paper, in an after-dryer in a paper machine. The paper web is first dried in a forward dryer section of the paper machine by one or more groups with single-wire draw that are open downward on support of a drying wire, the paper web is then finished in a finishing section, e.g., surface-sized or coated, and thereafter, the paper web is dried by an upwardly open inverted group with single-wire draw. In the inverted group with single-wire draw, the tendency of curling formed in the paper web in the forward dryer section can be substantially eliminated and/or compensated for. In the alternative, to eliminate or compensate for the tendency of curling formed in the paper web in the forward dryer section, hot moist air may be fed into certain locations into connection with the dryer groups in an after-dryer in order to restrain the evaporation, or hot dry air may be fed in order to promote the evaporation from the side of the web that is desirable in view of the control of curling.

9 Claims, 5 Drawing Sheets

AFTER-DRYER IN A PAPER MACHINE

This application claims the benefit of U.S. provisional patent application No. 60/030,915, filed Nov. 14, 1996.

FIELD OF THE INVENTION

The present invention relates to a method for drying a paper web to be surface-treated, in particular fine paper, in an after-dryer in a paper machine. The paper web is first dried in a forward dryer section of the paper machine by passing through a number of successive groups with single-wire draw that are open downwards on support of a drying wire, after which the paper web is passing through a finishing section to be finished, e.g., surface-sized or coated.

Further, the present invention relates to an after-dryer of paper machine for drying a paper web to be surface-treated, in particular fine paper. In the paper machine, there is a forward dryer section including a number of successive groups with single-wire draw that are open downwards arranged before the after-dryer, and a finishing section arranged after the forward dryer section in which there are devices for surface-sizing or coating the paper web.

BACKGROUND OF THE INVENTION

As known in the prior art, in multi-cylinder dryers of paper machines, twin-wire draw and/or single-wire draw is/are employed. When employing twin-wire draw, a group of drying cylinders comprises two wires which press the web one from above and the other one from below against heated cylinder faces of drying cylinders arranged in rows. Between the rows of drying cylinders, which are usually horizontal rows, the web has free and unsupported draws which are susceptible to fluttering and may cause web breaks, in particular when the web is still relatively moist and, therefore has a low strength. For this reason, in recent years, ever increasing use has been made of the single-wire draw in which each group of drying cylinders includes only a single drying wire on whose support the web runs through the entire group so that the drying wire presses the web on the drying cylinders against the heated cylinder faces thereof, whereas on the reversing cylinders or rolls between the drying cylinders the web remains at the side of the outside curve. Thus, in single-wire draw, the drying cylinders are arranged outside the wire loop, and the reversing cylinders or rolls are arranged inside the wire loop.

In so-called normal groups with single-wire draw, known in the prior art, the heated drying cylinders are placed in an upper row and the reversing cylinders or rolls are placed in a lower row below the upper row of drying cylinders, which rows are typically horizontal and parallel to one another. In the following, when the terms "normal (dryer) group" and "inverted (dryer) group" are used, what is meant is expressly groups with single-wire draw in multi-cylinder dryers, of the type mentioned above. In an inverted dryer group, the heated drying cylinders are placed in a lower row and the reversing cylinders or rolls are placed in an upper row above the lower row of drying cylinders.

When paper is dried by means of normal groups with single-wire draw from the side of its bottom face, the drying is asymmetric and if such asymmetric drying is extended over the entire length of the forward dryer section, the drying takes place so that first the bottom-face side of the paper web is dried and, when the drying makes progress, the drying effect is also extended to the side of the top face of the paper web. Under these circumstances, the dried paper is usually curled and becomes concave, when viewed from above.

As known in the prior art, the tendency of curling of paper (or the tendency to curl) is already affected in connection with the web formation, in particular at the sheet formation stage by means of the selection of the difference in speed between the slice jet and the wire, and by means of other running parameters. For example, in the case of copying paper, by means of unequalsidedness of drying in the after-dryer, a suitable initial curl form is regulated for the sheet in order that the curling of the paper after one-sided or double-sided copying could be optimized. In the case of copying paper, the reactivity of curling, i.e., the extent to which curling occurs per unit of change in moisture content, is affected to a greater extent by means of a multi-layer structure of the paper, which is produced in connection with the web formation in the wet end.

The most recent technology related to the present invention in high-speed paper machines, in particular in fine-paper machines, is based on dryer sections in which there is single-wire draw over the major part of the length of the machine and, with a view toward controlling the tendency of curling of paper, in practice, an inverted group has also almost always been used in order that the drying may be made sufficiently symmetric in the z-direction.

In the prior art, constructions are known for an after-dryer for paper to be coated, in particular for fine paper or equivalent, in which there is first an upper cylinder and a lower cylinder and after this, one group that employs normal single-wire draw and thereafter, a necessary number of dryer groups that make use of twin-wire draw. In these applications, it is a problem that, in view of the tendency of curling of paper, the ratio of the upper and lower cylinders is inappropriate if the curling is to be regulated efficiently.

In prior art after-dryers, in particular for fine paper, in which the drying has been regulated so that the emphasis is on the lower cylinders, problems are often also encountered in relation to the moisture of air. The hood of the after-dryer, and in particular the pocket spaces of the draw(s) therein, are often excessively dry in order to control the curling. The problems described above cannot be controlled by means of an increased moisture level in the hood alone, but the moisture levels in the upper and lower pocket spaces in the draw should also be separately adjustable.

Groups of the type mentioned above for finishing of paper to be coated, in particular of fine paper, have been described, among other things, in the current assignee's Finnish Patent Application No. 950434, filed Feb. 1, 1995.

OBJECTS AND SUMMARY OF THE INVENTION

It is an object of the present invention to further develop the paper machine constructions disclosed in Finnish Patent Application No. 950434 so that the tendency of curling of paper can be controlled more efficiently in an after-dryer of the paper machine.

It is a further object of the present invention to provide a construction for an after-dryer suitable for use in particular in dryer sections in which it has not been possible or desirable to control the curl of the paper web in a forward dryer section alone.

It is another object of the present invention to provide an arrangement in which, in an after-dryer of a paper machine, the ratio of moisture between the upper and lower pockets can be regulated so that the moisture levels in the pocket spaces can be used for controlling the curling of the paper web.

It is still another object of the present invention to provide an arrangement in a paper machine including an after-dryer in which the curling of paper is controlled so that the after-dryer does not become substantially longer in comparison with existing after-dryers.

In view of achieving the objects stated above and others, in one exemplifying embodiment of the method in accordance with the present invention, after the surface-sizing or coating of the paper web, the paper web is dried by means of an upwardly open, inverted group with single-wire draw, in which connection the tendency of curling formed in the paper web in the forward dryer section can be substantially eliminated and/or compensated for. In an alternative exemplifying embodiment, hot, moist air is fed into connection with the dryer groups in the after-dryer at certain locations therein in order to restrain the evaporation, or hot dry air is fed to promote the evaporation from the side of the web at certain locations therein desirable with a view toward the control of curling of the web. In this manner, a tendency of curling that is formed in the paper web in the forward dryer section can be substantially eliminated and/or compensated for.

In another exemplifying embodiment of the invention, after the surface sizing or coating of the paper web, the paper web is dried by means of an upwardly open, inverted group with single-wire draw, and in addition, hot moist or dry air is fed to the desired locations into connection with the dryer groups in the after-dryer, in which connection the tendency of curling formed in the paper web in the forward dryer section can be substantially eliminated and/or compensated for.

One exemplifying embodiment of the after-dryer of a paper machine in accordance with the present invention comprises, after the surface-sizing or coating devices, an upwardly open, inverted group with single-wire draw in which the tendency of curling that is formed in the paper web in the forward dryer section can be substantially eliminated and/or compensated for. In another exemplifying embodiment, air supply devices are arranged in connection with the dryer groups in the after-dryer to feed hot moist or dry air to the desired locations, in which connection the tendency of curling that is formed in the paper web in the forward dryer section can be substantially eliminated and/or compensated for.

In an embodiment of a dryer section in accordance with the invention, after the surface-sizing or coating devices, an after-dryer is placed which first includes an upwardly open, inverted group with single-wire draw and, in connection with the dryer groups, air supply devices arranged to feed hot moist or dry air to the desired locations, in which connection the tendency of curling that is formed in the paper web in the forward dryer section can be substantially eliminated and/or compensated for.

According to the present invention, the after-dryer is started with a dryer group that applies an inverted single-wire draw, in which case, in view of the tendency of curling of paper, the desired ratio of upper cylinders to lower cylinders is obtained. After the coating device, size press or equivalent, the drying is started by means of an inverted group with single-wire draw, and this group is followed by either normal or inverted groups with single-wire draw or by dryer groups based on twin wire draw. The paper web is brought from the coating device or equivalent onto an upper or lower cylinder, and after this cylinder, the inverted dryer group follows. Before the inverted group, there can be a spreader roll or spreader rolls, a reversing dryer, an airborne, infrared or combination dryer. One of the most important advantages of this arrangement in accordance with the present invention is the formation of a ratio of upper cylinders to lower cylinders that is appropriate and correct in view of the tendency of curling of paper, without resulting in any additional length to the dryer section. Owing to this, no additional arrangements are needed to supply additional heat to provide unequalsidedness.

In accordance with the present invention, in the after-dryer of the paper machine, moist air is introduced at appropriate locations inside the hood, in which case the moisture levels in the different pocket spaces formed by the cylinders, rolls and wires in the dryer groups can be controlled. For supplying moisture, it is possible to use air supply devices, ventilators, blow pipes, etc., arranged in the after-dryer. Through these devices, hot moist air is supplied into the desired upper/lower pockets, in which connection, the control of curling takes place so that evaporation taking place from the wrong side of the paper (i.e., that side of the web from which evaporation of water from the web is not desired) is restrained by means of the supply of hot moist air. The necessary moist air is obtained, for example, from the exhaust air from the hood or from suction rolls. According to preferred additional embodiments of the invention, in the devices that supply air to the after-dryer, appropriately selected moisture levels of air are employed in order to achieve the desired distribution of moisture in the web. The air moisture levels at all of the different moisture supply points can be regulated separately, and so also the exhaust quantities of all the air exhausts can be regulated separately, if necessary. Also, the supply of hot dry air onto the side or sides of the web from which evaporation is to be promoted is included in the scope of the present invention.

Thus, it is appreciated that the supply of hot, moist air to one side of the web will affect the moisture profile at that side and by regulating this supply, the tendency of curling of the web can be controlled. Similarly, the supply of hot, dry air to one side of the web will affect the moisture profile at that side and by regulating this supply, the tendency of curling of the web can also be controlled. It is contemplated that it would be possible to supply hot, dry air to one side of the web and hot, moist air to the other side of the web control curling of the web or even supply two flows of hot, moist air having a different moisture content to a respective side of the web (or two flows of hot, dry air having different moisture content to a respective side of the web) with a view toward compensating for or eliminating the tendency of curling of the web imbued therein the forward dryer section. Thus, in general, the moisture content of the hot air is controlled relative to the web in order to achieve the desired effect on the web, i.e., restrain or promote evaporation of water from the web or moisten the web.

In one embodiment of the method for drying a paper web after the web is initially dried in a forward dryer section of the paper machine by passing through at least one dryer group with single-wire draw and then surface-sized or coated in a finishing section of the paper machine, an inverted dryer group with single-wire draw is arranged after the finishing section and the web is passed through the inverted dryer group to dry the web such that the tendency of curling of the web formed in the paper web in the forward dryer section is substantially eliminated and/or compensated for. Both sides of the web may be coated and/or moistened in the finishing device by passing through a double-sided coating device in the finishing section, and the web may then be passed through an additional dryer group after the inverted dryer group with single-wire draw in which heat is applied directly at least to a side of the web opposite that side of the web dried by direct contact with the heated drying cylinders in the inverted dryer group. In one embodiment, the web may be passed from the finishing section onto a drying cylinder arranged between the finishing section and the inverted dryer group and from this drying cylinder into the inverted dryer group.

In one embodiment of the method in accordance with the invention, the web is passed from the finishing section into and through an after-dryer including at least one dryer group of drying cylinders, and curling of the web is controlled in the after-dryer by feeding hot air having a certain moisture content relative to the web into the vicinity of the web to restrain or promote evaporation of water from one or both sides of the web such that the tendency of curling formed in the paper web in the forward dryer section is substantially eliminated and/or compensated for. The curling of the web may be controlled by feeding hot, moist air into the vicinity of the web to restrain evaporation of water from one or both sides of the web or feeding hot, dry air into the vicinity of the web to promote evaporation of water from one or both sides of the web. The hot, moist air may be fed in a regulated quantity into the at least one dryer group through blow boxes and/or blow-suction boxes arranged in the at least one dryer group in proximity to the web or by means of air supply devices spaced at a distance from the web. Also, air may be removed air from the at least one dryer group by means of moisture removing devices spaced at a distance from the web. In some embodiments, curling of the web is controlled by feeding hot, moist air into pocket spaces defined between drying wires, drying cylinders and reversing rolls in the dryer group(s).

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1:
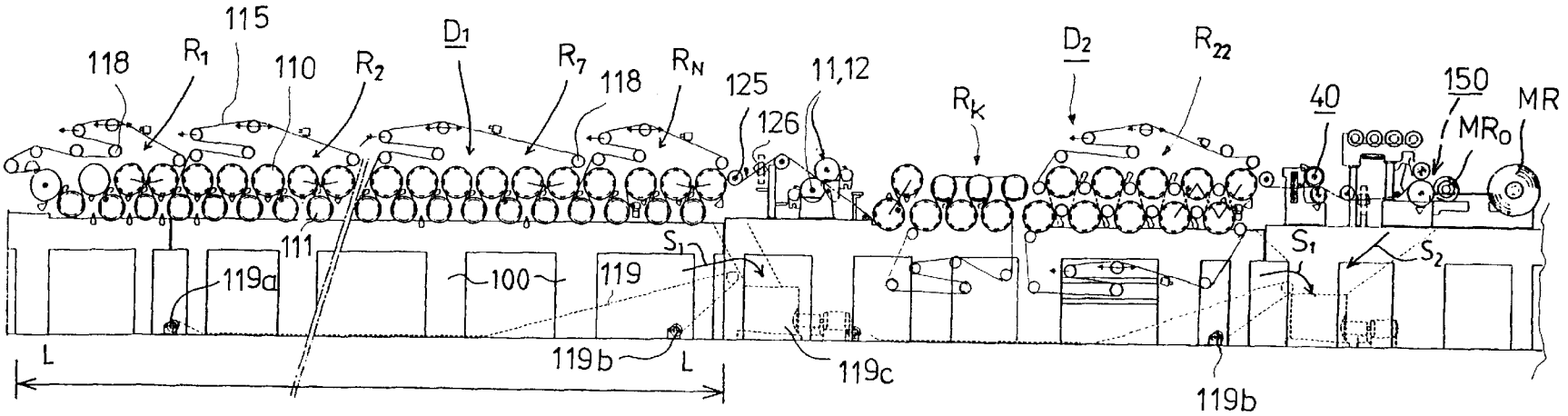
FIG. 1 is a schematic illustration of an embodiment of a construction of the dry end of a paper machine, showing the forward dryer section and the following finishing section.

Referring to FIGS. 1–6 wherein like reference numerals refer to the same or similar elements, as shown in FIG. 1, a paper web is passed from a press section (not shown) into a forward dryer section $D_1$ and more particularly, onto a drying wire of the first group $R_1$ with single-wire draw in the forward dryer section $D_1$. The web is made to adhere to the wire by the effect of a vacuum in suction boxes. In the forward dryer section $D_1$, there are normal groups $R_{1,\ldots,N}$, generally N=4–11, preferably N=6–9, and typically N=9. All of the single-wire groups $R_1, \ldots, R_N$ are so-called normal groups, in which steam heated smooth-faced drying cylinders 110 are arranged in an upper horizontal row and reversing suction cylinders 111 are arranged in a lower horizontal row. The web has closed draws over the gaps between the adjacent dryer groups.

Each normal group $R_1, \ldots, R_N$ has a drying wire 115 of its own, which is guided by respective guide rolls 118. The drying wires 115 press the web W to be dried on the drying cylinders 110 against the smooth heated cylinder faces thereof whereby on the reversing cylinders 111, the web W remains on the outer face of the wire 115 at the side of the outside curve, i.e., the wire 115 is interposed between the web and the surface of the reversing cylinders. On the reversing cylinders 111, the web W is kept reliably on support of the wire 115 against the effect of centrifugal forces by the effect of a vacuum present on grooved faces of the reversing cylinders 111, if present, or on a perforated mantle of an equivalent suction roll, by means of which effect cross-direction shrinkage of the web W is also prevented. As the reversing suction cylinders 111, particularly favorably suction cylinders are used which are marketed by the current assignee with the trade mark "VAC-ROLL"™ and which have no inside suction box, and with respect to the details of the constructions of these cylinders reference is made to the current assignee's Finnish Patent No. 83,680 (corresponding to U.S. Pat. Nos. 5,022,163 and 5,172,491, entirely incorporated herein by reference).

In the forward dryer $D_1$, the support contact between the web and the drying wire 115 is also kept adequate on the straight runs between the drying cylinders 110 and the reversing cylinders 111 by employing blow suction boxes at least on the runs from the drying cylinders 110 to the reversing cylinders 111. By means of such blow suction boxes, the formation of pressures induced by the wire 115 in closing wedge-shaped nip spaces defined between the wire 115 and the mantles of cylinders 111 is prevented. Blow suction boxes are understood herein to designate blow boxes whose blowing of air produces a vacuum, and these boxes do not communicate with sources of vacuum.

Further, in the forward dryer section $D_1$, in the groups $R_1, \ldots, R_N$ with single-wire draw, blow boxes are also used in the gaps between the reversing cylinders 111 By means of these blow boxes, the intermediate spaces defined between the reversing cylinders 111 are air-conditioned and evaporation from the web is promoted. The faces of the drying cylinders 110 can be kept clean by means of doctors. In the forward dryer section $D_1$, broke removal by means of gravity can be applied because the groups $R_1, \ldots, R_N$ with single-wire draw are open downwards so that, in the event of a web break, the removal of paper broke can be carried out below the dryer groups $R_1, \ldots, R_N$ that are open downwards, substantially by the effect of gravity, onto a broke conveyor placed underneath. FIG. 1 shows a conveyor belt 119 of the broke conveyor and its associated drive rolls 119*a*,119*b*. The paper broke is carried on the belt 119 of the broke conveyor into a pulper 119 *c* placed at one end of the broke conveyor.

At the rear end of the forward dryer section $D_1$, there is a finishing unit $D_2$, which includes, among other things, a surface-treatment or surface-coating device, an after-dryer, a calender, and a machine reel-up, for example a Pope type reel-up. The machine reel that is being produced by means of the reel-up 150 is denoted by reference $MR_O$, and one complete machine reel is denoted by reference MR.

After the forward dryer section $D_1$, the paper web W, which has been dried to a dry solids content $k_2$ from about 96% to about 99%, is passed over paper guide rolls 125 and over a measurement beam 126 which measures the property profiles of the paper and is placed between the paper guide rolls 125. The web W continues into the coating device, which is, for example, a coating device marketed by the current assignee under the name Sym-Sizer™. The coating device includes two opposite coating rolls 11 and 12, in connection with each of which there are size feed devices so that the paper web is coated from both sides in the coating nip between the rolls 11 and 12. After the coating device, the web W is passed into the after-dryer.

Figure 2:
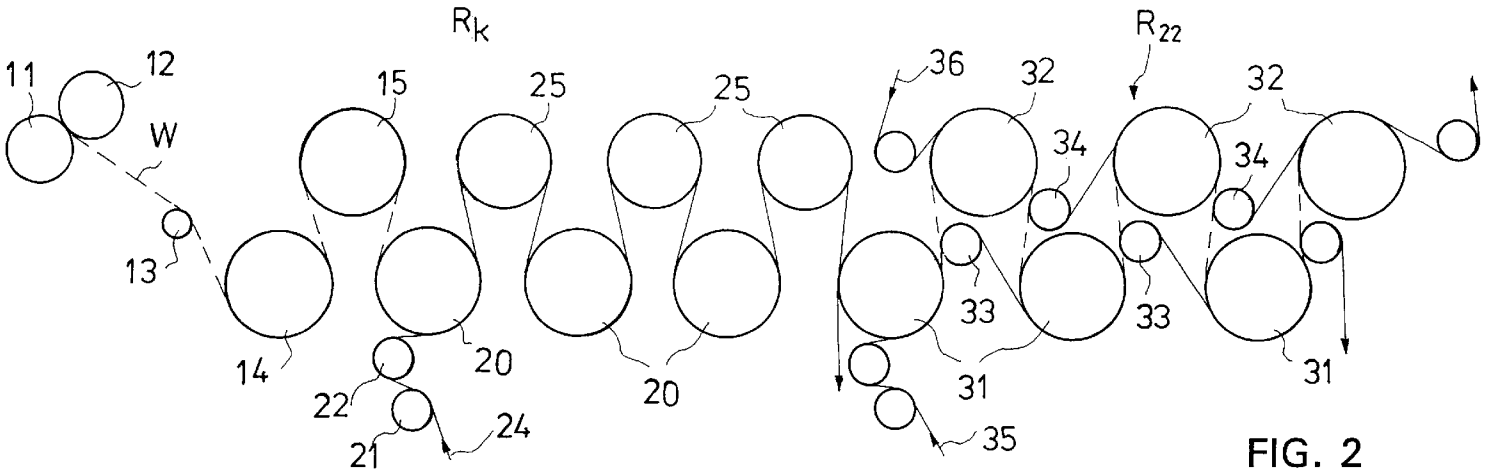
FIG. 2 is a schematic illustration of an after-dryer in accordance with the present invention.

As shown in FIG. 2, after the coating rolls 11,12, the web W is passed over a guide roll 13 onto a first drying cylinder 14 in the after-dryer and thereafter onto a second drying cylinder 15. On the first drying cylinder 14, the top side of the web W is placed against the cylinder face thereof, and on the second drying cylinder 15, the bottom face of the web is placed against the cylinder face thereof After this, the web is passed into an inverted dryer group Rk with single-wire draw, in which drying cylinders 20 are arranged in a lower row and reversing rolls or cylinders, preferably rolls 25 that are marketed by the current assignee under the trade mark VAC-ROLL and that have no inside suction box, are arrranged in an upper row. A wire 24 that supports the paper web W to be dried enters from below the group Rk, guided by guide rolls 21,22, onto a first one of the drying cylinders 20, and after this, the wire runs meandering from the drying cylinders 20 onto a reversing roll 25 in the upper row so that on the drying cylinders 20, the web W is placed between the heated cylinder face and the wire 24. After the last reversing roll 25 in the group Rk, the web W is passed on the wire 24 of the inverted group onto a drying cylinder 31 in the lower row in the following dryer group R22, with twin-wire draw, in which group the web W runs from the drying cylinder 31 in the lower row onto a drying cylinder 32 in the upper row. Between the rows of cylinders, the web has a free draw W', and both the drying cylinders 32 in the upper row and the drying cylinders 31 in the lower row have drying wires 36,35, respectively, of their own as well as wire guide rolls 34,33, respectively, of their own.

Figure 3B:
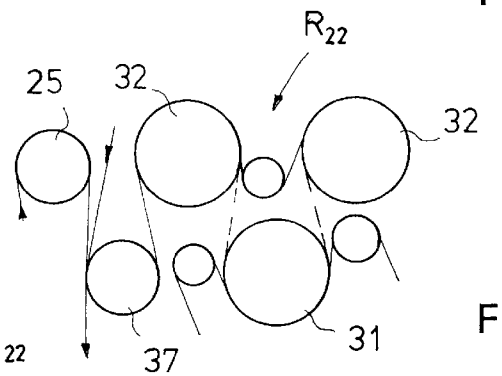
FIGS. 3A, 3B and 3C are illustrations in part of different variations of the after-dryer as shown in FIG. 2, which variations are included in the scope of the invention.
Figure 3A:
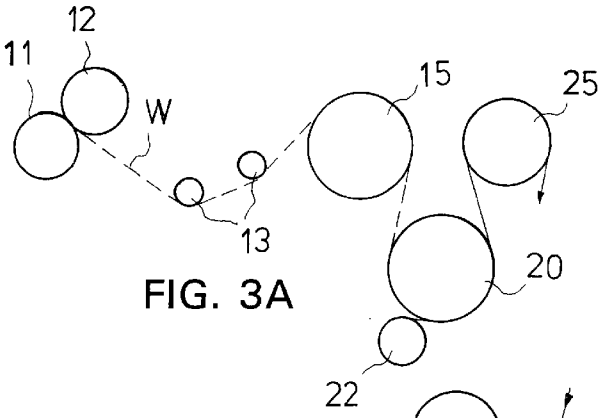
Figure 3C:
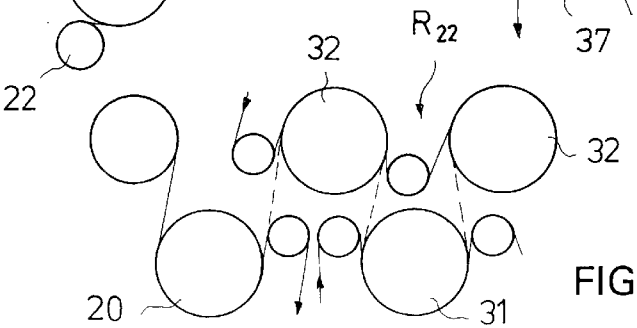

In the exemplifying embodiment shown in FIGS. 3A, 3B and 3C, after the coating rolls 11,12, there are two guide rolls 13, by whose means the web W is passed onto the drying cylinder 15 placed in the upper row, after which the web is passed onto the first drying cylinder 20 in the inverted group Rk, which cylinder 20 is thus in the lower row in the group. In this respect, the inverted group is similar to the draw illustrated in FIG. 2, but after the inverted group Rk, the web W is passed from the last suction roll 25 in the inverted group Rk onto a suction cylinder 37 arranged in connection with the upper wire in the group R22 with twin-wire draw. Suction cylinder 37 is arranged substantially at the same level as the lower cylinders 31 in the group R22 with twin-wire draw. In the embodiment shown in FIG. 3C, the web is passed from the last drying cylinder 20 in the inverted group Rk directly onto the first cylinder 32 in the upper row in the group with twin-wire draw.

Figure 4A:
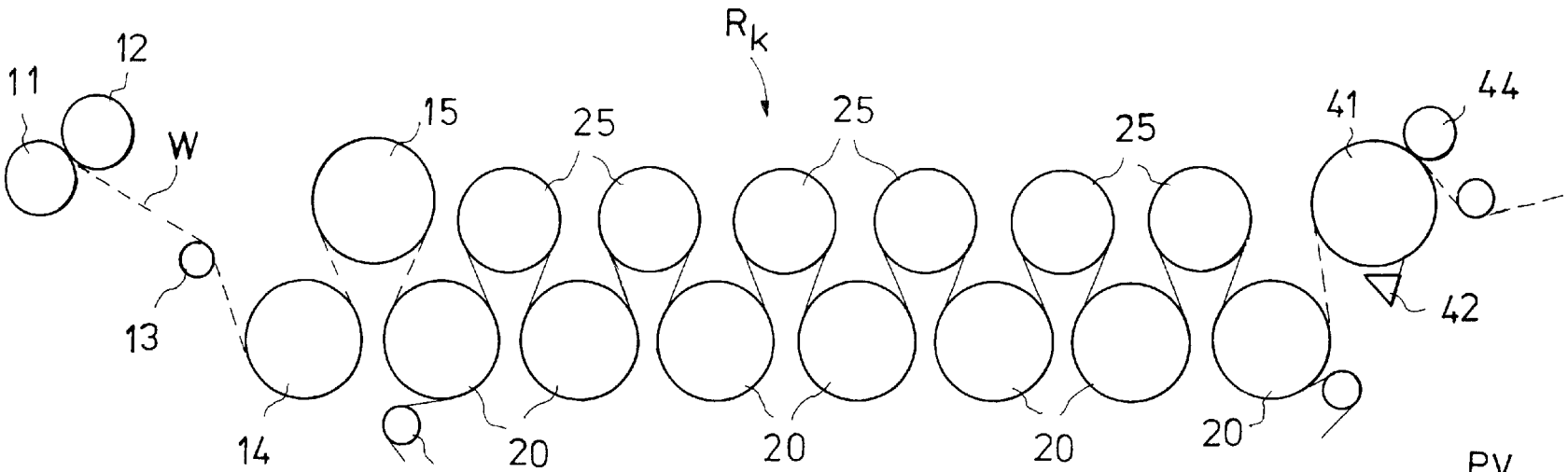
FIGS. 4A and 4B are further illustrations of an embodiment of an after-dryer in accordance with the present invention.

In the embodiment shown in FIG. 4A, the web is passed over the guide roll 13 after the coating rolls 11,12 in a manner similar to the exemplifying embodiment shown in FIG. 2, but in this embodiment, the after-dryer is composed of only one inverted single-wire draw dryer group Rk. After the dryer group Rk, a drying cylinder 41 is arranged in an upper row and a calender nip is formed in connection with drying cylinder 41 by means of an additional roll 44. Below the cylinder 41, there may be a doctor 42 for doctoring the cylinder 41.

Figure 4B:
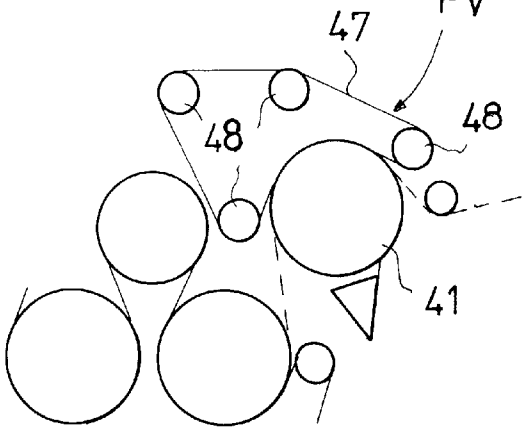

In the embodiment shown in FIG. 4B, in the portion PV after the inverted group in the after-dryer, a holding wire 47 is arranged in connection with the drying cylinder 41 and has guide rolls 48 of its own.

Figure 5A:
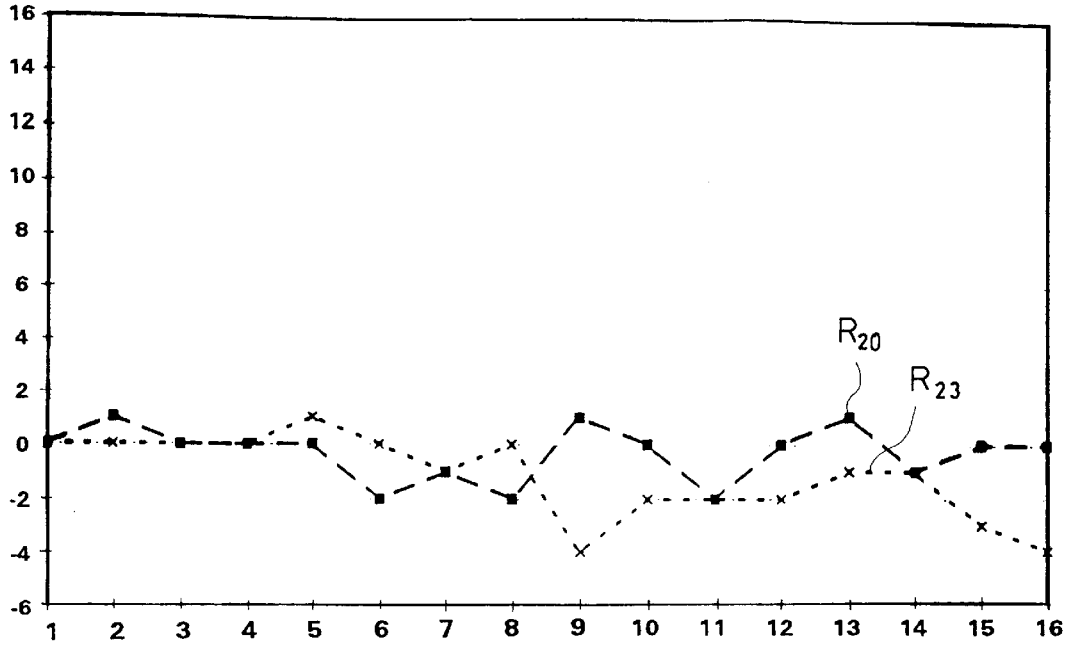
FIGS. 5A and 5B are schematic illustrations of test results related to curling of the paper web in the after-dryer.
Figure 5B:
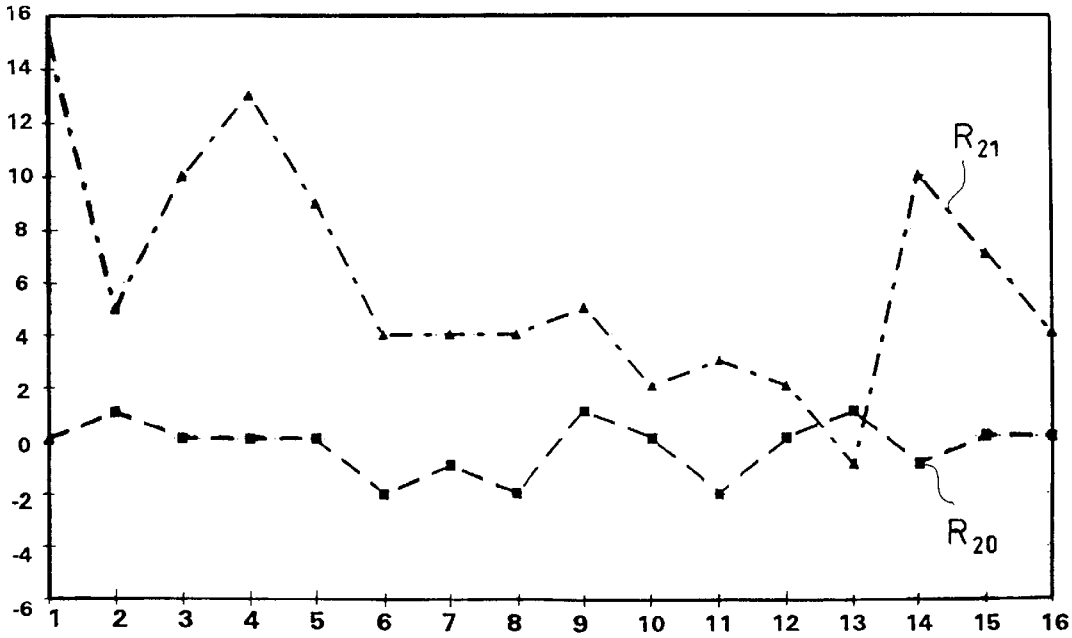

The schematic test results illustrated in FIGS. 5A and 5B are related to a test in which the effects of modes of running of the forward dryer section and after-dryer on the tendencies of curling of paper were examined. The machine that was used in the test comprised a former, a press, a forward dryer section, in which there was, in the beginning, one single-wire group followed by three twin-wire groups, a coating device, and an after-dryer, which consisted of two twin-wire groups. The paper grade was copying paper, 76 grams per sq.m. The three points of comparison in the test were:

R23 normal running mode of the machine: all cylinders in the forward dryer are open; in the after-dryer slightly more heat is supplied to the top face of the paper than to the bottom face, R20 the supply of steam to all lower cylinders in the forward dryer in the machine is closed; the after-drying was normal, i.e., as in R23, R21 the supply of steam to all lower cylinders in the forward dryer in the machine was closed; the supply of heat in the after-dryer had been changed so that the emphasis was significantly on the bottom face of the paper.

During the test points R23, R20 and R21, no other changes affecting the curl of the paper were made except the regulations in the dryer sections.

The results of one method of curl measurement are illustrated in FIGS. 5A and 5B. In the method, from a sample taken in the cross direction of the web, a number (in this case 16) of small pieces of paper sample are cut off, and the curling of these pieces is examined and measured under conditions constructed for the purpose. Based on the results, among other things, graphs that illustrate the cross-directional curl profile, as shown in FIGS. 5A and 5B, can be drawn. When the profiles of the points R20 and R23 are compared with one another, it cannot be said that there is a significant difference between them. Between these points, the difference in the running mode is present in the forward dryer section: in R20 the steam supply into the lower cylinders is closed, in R23 open. The difference in the running mode between R20 and R21 is present both in the forward drying and in the after-drying. In the former test, it was, however, noticed that the difference in the running mode in the forward dryer section is insignificant from the point of view of curling, so that the profiles in FIG. 5B indicate the considerable effect of the after-dryer on the curling.

Figure 6:
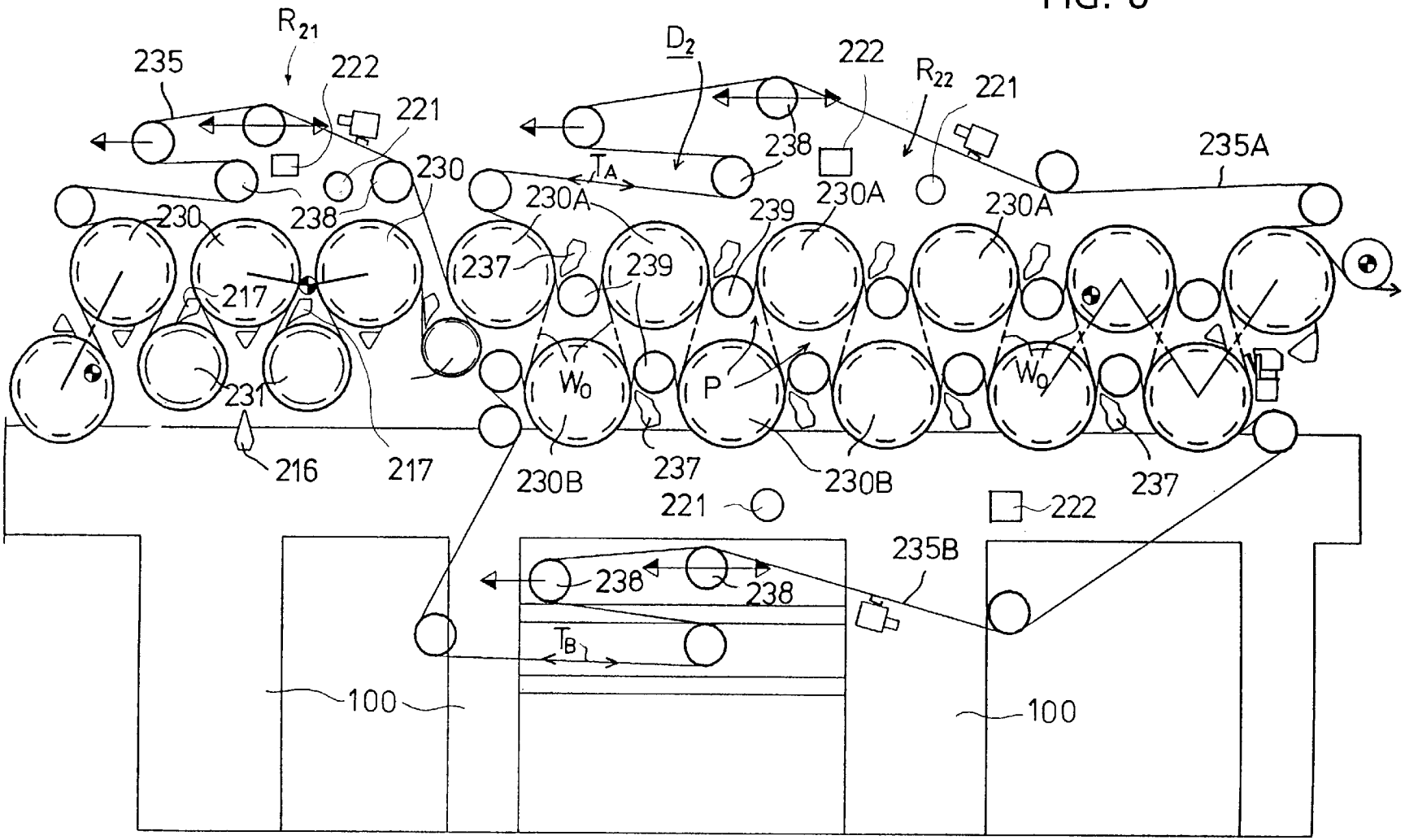
FIG. 6 is a schematic illustration of a further embodiment of the invention.

In the after-dryer shown in FIG. 6, whose frame constructions are denoted by reference numeral 100, there is first one dryer group $R_{21}$ with normal single-wire draw, which group is followed by a group $R_{22}$ with twin-wire draw. The group $R_{21}$ with single-wire draw comprises heated drying cylinders 230 in an upper row and reversing rolls 231 in a lower row. The wire of the group with single-wire draw is denoted by reference numeral 235. The wire guide rolls 238 guide the run of the wire 235. The group $R_{22}$ with twin-wire draw comprises two horizontal rows of steam-heated drying cylinders 230A and 230B, and the web has free draws $W_O$ on the runs between these rows. The group $R_{22}$ includes an upper wire 235A, which runs guided by guide rolls 238 and by guide rolls 239 arranged in the gaps between the upper cylinders 230A. Similarly, the group $R_{22}$ includes a lower wire 235B, which runs guided by respective guide rolls 238 and respective guide rolls 239 arranged in gaps between the lower cylinders 230B.

As shown in FIG. 6, in the vicinity of the wire guide rolls 239, at the inlet side of the web W and the drying wire 235A and 235B, air blow boxes 237 are employed. Out of the blow boxes 237 arranged in the gaps between the drying cylinders 230A, 230B, air jets of appropriate directions and blow velocities are applied into connection with the runs of the drying wire 235A,235B and with the free sectors of the wire guide rolls 239, placed in the vicinity of these blow boxes. By means of the air jets, the support contact between the drying wires 235A,235B and the web W is promoted, the formation of detrimental differences in pressure is prevented, and fluttering of the web W on the free draws $W_O$ is prevented. The blowings can also be applied through the drying wires 235A,235B, by means of which ventilation of the pocket spaces P formed in the gaps between the drying cylinders 230A,230B can be promoted.

On the runs from the drying cylinders 230 onto the reversing cylinders 231 in the single-wire draw group $R_{21}$, there are blow-suction boxes 217, by whose means formation of pressures induced by the wire 235 is also prevented in the closing wedge-shaped nip spaces between the wire 235 and the mantles of the cylinders. The blow-suction boxes 217 are understood to designate blow boxes whose air blowing creates a vacuum, and these boxes 217 do not communicate with sources of vacuum. With respect to the details of the constructions of these blow-suction boxes 217, which are marketed by the current assignee under the trade mark "UNO RUN BLOW BOX"™, reference is made to the current assignee's Finnish Patent Nos. 59,637, 65,460, and 80,491 (corresponding to U.S. Pat. Nos. 4,441,263, 4,516,330, and 4,905,380, respectively, incorporated herein by reference in their entirety). After the introduction of the "UNO RUN BLOW BOX"™ in the market by the current assignee, others have suggested some blow-box constructions, with respect to which reference is made to U.S. Pat. Nos. 4,502,231 (assigned to J. M. Voith GmbH) and 4,661,198 (assigned to Beloit Corp.), whose applications in positions of blow boxes are also included in the overall concept of the present invention.

In the gaps between the reversing cylinders 231, there are blow boxes 216, by whose means these intermediate spaces are air-conditioned and evaporation from the web W is promoted.

In connection with each of the dryer groups $R_{21}$,$R_{22}$ in the after-dryer, an additional supply of moisture has been arranged for the purpose of controlling the curling. Moist, hot air is blown into connection with the dryer groups, in particular into the pocket spaces P. The values of moisture and temperature to be selected depend to a very great extent on the conditions; for example, the moisture limits can be from about 80 to about 400 grams of $H_2O$ per kilogram of dry air, and the temperature from about 60° C. to about 95° C. The moisture can be introduced in connection with the dryer group by means of the above blow boxes 237, blow-suction boxes 217, blow boxes 216 and/or by means of separate air supply devices 222, and in connection with each group, it is also possible to arrange a separate air removing device (devices) 221. If necessary, the moisture content and the temperature of each air supply device 237,217,216,222 can be regulated separately, and so also the evacuation efficiency of the moisture removing points 221 can be regulated separately. In FIG. 6, the arrangement of control of the moisture state of the dryer groups in this after-dryer is illustrated quite schematically, but it can be accomplished by means of principles and devices in themselves known to a person skilled in the art.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

What is claimed is:

1. A paper machine comprising a plurality of drying cylinders for drying a web, said plurality of drying cylinders being arranged before a finishing section and each and every one of said drying cylinders being arranged along only one side of the web, a finishing section arranged immediately after the plurality of drying cylinders in a running direction of the web and in which the web is surface-sized or coated, the web having a tendency of curling as a result of the arrangement of said drying cylinders along only one side of the web prior to said finishing section, and an after-dryer for drying the web after the web passes through the finishing section comprising an inverted dryer group with single-wire draw including drying cylinders arranged in a first row, reversing cylinders arranged in a second row above said first row, and a drying wire for carrying the paper web over said drying cylinders and said reversing cylinders and through said inverted dryer group, said inverted dryer group being structured and arranged such that the tendency of curling of the web is substantially eliminated.

2. A paper machine comprising a plurality of drying cylinders for drying a web, said plurality of drying cylinders being arranged before a finishing section and each and every one of said drying cylinders being arranged along only one side of the web, a finishing section arranged immediately after the plurality of drying cylinders in a running direction of the web and in which the web is surface-sized or coated, the web having a tendency of curling as a result the arrangement of said drying cylinders along only one side of the web prior to said finishing section, and an after-dryer for drying the web after the web passes through the finishing section comprising at least one dryer group including drying cylinders, reversing rolls and a drying wire for carrying the web over said drying cylinders and said reversing rolls, and feeding means for feeding hot, moist air or hot, dry air into the vicinity of the web to affect the moisture level at one or both sides of the web in said at least one dryer group to substantially eliminate the tendency of curling in the web.

3. The after-dryer of claim 2, wherein said feeding means comprise at least one of blow boxes and blow-suction boxes.

4. The after-dryer of claim 2, wherein said feeding means are structured and arranged to direct hot, moist air at the web, further comprising air removal means for removing air from the vicinity of the web, said air removal means being separate from said feeding means.

5. The after-dryer of claim 4, wherein said feeding means comprise means for regulating the moisture content of the web.

6. A paper machine comprising a plurality of drying cylinders for drying a web, said plurality of drying cylinders being arranged before a finishing section and each and every one of said drying cylinders being arranged along only one side of the web, a finishing section arranged immediately after the forward dryer section in a running direction of the web and in which the web is surface-sized or coated, the web having a tendency of curling as a result of the arrangement of said drying cylinders along only one side of the web prior to said finishing section, and an after-dryer for drying the web after the web passes through the finishing section comprising an inverted dryer group with single-wire draw including drying cylinders arranged in a first row, reversing cylinders arranged in a second row above said first row, and a drying wire for carrying the paper web over said drying cylinders and said reversing cylinders and through said inverted dryer group, and feeding means for feeding hot, moist air or hot, dry air to specific locations in said at least one dryer group into contact with the web to substantially eliminate the tendency of curling in the paper web.

7. The after-dryer of claim 6, wherein said feeding means comprise at least one of blow boxes and blow-suction boxes.

8. The after-dryer of claim 6, wherein said feeding means are structured and arranged to direct hot, moist air at the web, further comprising air removal means for removing air from the vicinity of the web, said air removal means being separate from said feeding means.

9. The after-dryer of claim 8, wherein said feeding means comprise means for regulating the moisture content of the web.

* * * * *